US007884739B2

(12) United States Patent
Reeves et al.

(10) Patent No.: US 7,884,739 B2
(45) **Date of Patent: *Feb. 8, 2011**

(54) SYSTEMS AND DEVICES FOR ASSESSING FINES FOR TRAFFIC DISTURBANCES

(75) Inventors: Jonathan Reeves, Roswell, GA (US); Barrett Kreiner, Woodstock, GA (US)

(73) Assignee: AT&T Intellectual Property I, LP, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/123,499

(22) Filed: May 20, 2008

(65) Prior Publication Data

US 2008/0221916 A1 Sep. 11, 2008

Related U.S. Application Data

(63) Continuation of application No. 11/410,625, filed on Apr. 25, 2006, now Pat. No. 7,375,652.

(51) Int. Cl.
*G08G 1/01* (2006.01)

(52) U.S. Cl. ..... 340/933

(58) Field of Classification Search ..... 340/933, 340/910, 917, 937, 438, 466; 382/104; 348/118
See application file for complete search history.

(56) References Cited

U.S. PATENT DOCUMENTS 6,100,819 A * 8/2000 White ..... 340/933
6,339,383 B1 * 1/2002 Kobayashi et al. ..... 340/907
6,633,238 B2 * 10/2003 Lemelson et al. ..... 340/909
6,970,102 B2 * 11/2005 Ciolli ..... 340/933
2003/0063015 A1 * 4/2003 Ebner et al. ..... 340/907
2003/0080878 A1 * 5/2003 Kirmuss ..... 340/936
2003/0189499 A1 * 10/2003 Stricklin et al. ..... 340/933
2006/0181433 A1 * 8/2006 Wolterman ..... 340/917

* cited by examiner

*Primary Examiner*—Phung Nguyen
(74) *Attorney, Agent, or Firm*—Parks IP Law LLC; Jennifer P. Medlin Esq.

(57) ABSTRACT

Traffic disturbances are detected and data is collected by various sensors where the data reflects the entity that is responsible for the disturbance and the number of vehicles that are impacted by the disturbance. The data is analyzed to determine whether a traffic violation has occurred and to then assess a fine based at least on the number of vehicles that have been impacted as a result of the traffic violation. The fine may then be collected by notifying the entity that is responsible, such as by sending a message to an electronic device of the entity. The notification may provide for an automated payment of the fine or an option to appeal the fine. Additionally, those affected by the traffic disturbance may be identified and granted a portion of the fine that has been imposed and collected.

11 Claims, 6 Drawing Sheets

SYSTEMS AND DEVICES FOR ASSESSING FINES FOR TRAFFIC DISTURBANCES

RELATED CASES

The present application is a continuation of U.S. patent application Ser. No. 11/410,625, entitled SYSTEMS AND METHOD FOR ASSESSING FINES FOR TRAFFIC DISTURBANCES, filed on Apr. 25, 2006, now issued as U.S. Pat. No. 7,375,652, and is hereby incorporated by reference in its entirety.

TECHNICAL FIELD

The present invention is related to traffic violations. More particularly, the present invention is directed to the assessment of fines for traffic violations.

BACKGROUND

Vehicular traffic can be greatly affected by disturbances in the normal flow of traffic. Blocking one lane of a multi-lane highway may result in traffic congestion that stretches for a mile or more. Furthermore, in some cases traffic may become congested in multiple directions, such as where the blockage occurs within an intersection. Often, the traffic disturbance is the result of someone committing a traffic violation such as running a stop light, speeding, reckless driving, or colliding with another vehicle.

When a traffic violation occurs, the individual committing the traffic violation may or may not be caught. When caught, either by a photo enforcement system or by a police officer, the fine is generally pre-determined based on the violation that has been committed. The entity pays a pre-determined monetary fine and accepts a predetermined number of violation points associated with the particular violation or the entity appeals the violation to challenge it. However, the fine associated with the violation has no relationship to the impact of the traffic disturbance that resulted from the traffic violation and may have less of a deterrent effect as a result.

SUMMARY

Exemplary embodiments address these issues and others by utilizing sensors to capture data regarding a traffic disturbance, including data representing the cause of the disturbance as well as data representing the impact. A determination can then be made from the data as to whether a traffic violation has occurred, and then a fine can be computed on the basis of both the traffic violation that has occurred and the impact that has resulted.

One embodiment is a computer readable medium containing instructions for assessing fines for traffic disturbances. Data regarding a cause of a traffic disturbance and data reflecting a number of vehicles impacted is collected. The collected data regarding the cause is compared to a traffic violation rule set to detect whether the data regarding the cause represents a traffic violation. Additionally, a total fine is computed based on the data reflecting the number of vehicles impacted.

Another embodiment is a device for determining whether liability applies for a traffic disturbance. The device includes an input receiving data representing a cause of the traffic disturbance and storage containing a traffic violation rule set setting forth multiple traffic violations. The device also includes a processor that compares the data representing the cause to the traffic violation rule set to determine whether the cause satisfies at least one of the traffic violations.

Another embodiment is a device for assessing a penalty for a traffic violation that causes a traffic disturbance. The device includes an input receiving data representing the number of vehicles impacted and receiving data representing which traffic violation has occurred. The device further includes storage containing an association of a fine per vehicle impacted to at least one traffic violation. The device also includes a processor that computes a total fine based on the data representing the vehicles impacted in relation to the fine per vehicle for the traffic violation that has occurred.

DETAILED DESCRIPTION

Embodiments provide for assessing fines to entities responsible for traffic disturbances where the fine may be based on the impact that has resulted from the traffic disturbance. Accordingly, where only a minor effect has resulted, the fine may be less severe than where a large traffic jam has occurred. In the case of a large traffic jam, the penalty may be much greater than what would typically be assessed for the particular violation that has occurred such that a strong deterrent exists to assist in reducing traffic violations during high volume traffic conditions.

Figure 1:
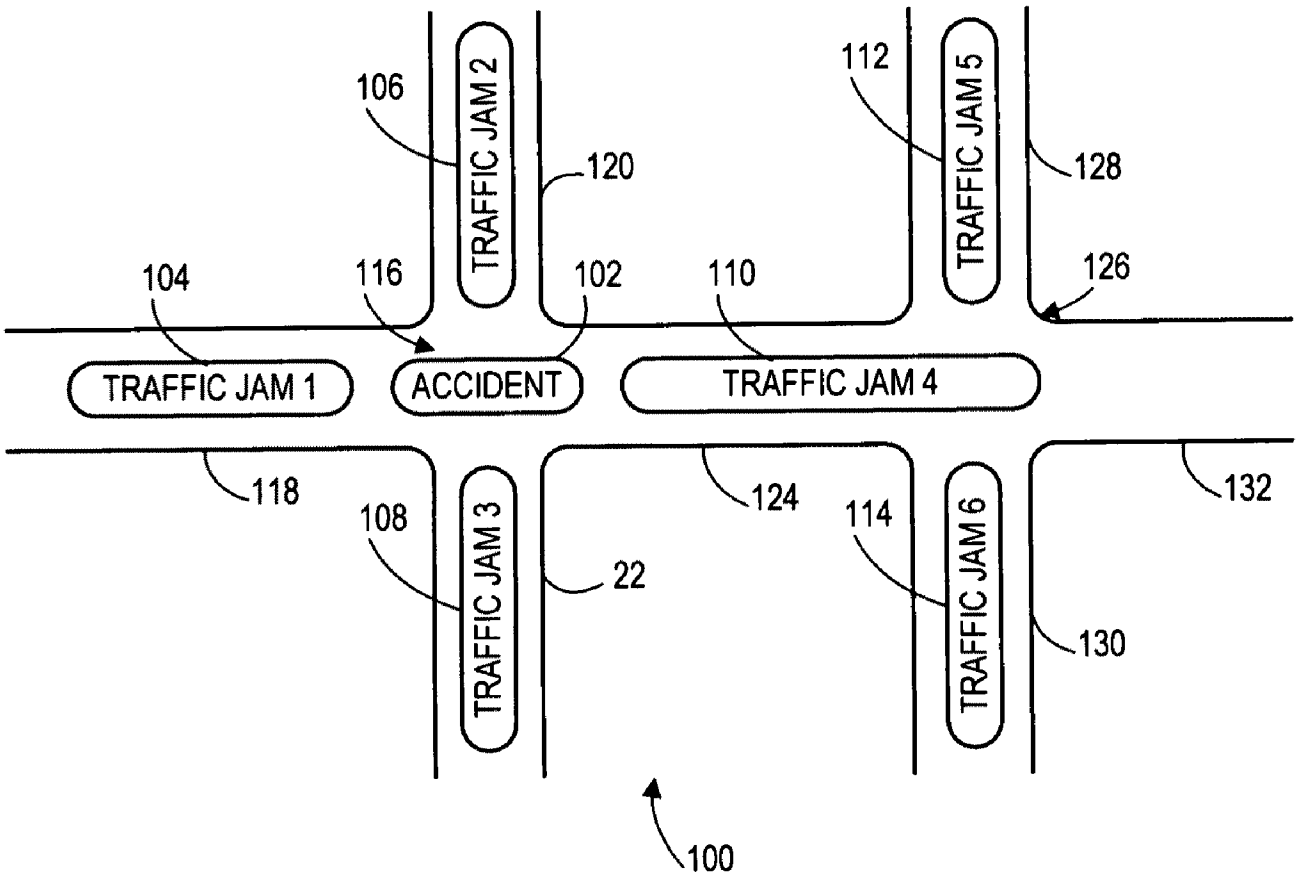
FIG. 1 shows an example of a traffic disturbance and the resulting impact.

FIG. 1 shows one example of a scenario 100 where a traffic disturbance has occurred. Here, an accident 102 or other event has occurred at an intersection 116. For example, there may be a vehicle-to-vehicle collision, construction, road work, a poorly situated delivery vehicle, and so forth. The intersection 116 has been virtually completely blocked due to the accident 102 and the result is a first traffic jam 104 on a stretch 118 of roadway, a second traffic jam 106 on a stretch 120 of roadway, a third traffic jam 108 on a stretch of roadway 122, and a fourth traffic jam 110 on a stretch of roadway 124. Furthermore, because another intersection 126 is nearby, the fourth traffic jam 110 extends through the intersection 126, thereby blocking intersection 126 and creating a fifth traffic jam 112 on roadway 128 and a sixth traffic jam 114 on roadway 130. As the fourth traffic jam 110 continues to grow over time and extend further onto roadway 132, additional intersections may also become affected.

As shown in FIG. 1, one accident 102 or other event may have many effects as the traffic system reaches gridlock. In large metropolitan areas, this can result in thousands of individuals being at a standstill for hours. The adverse effects are many, including the lost productivity of those individuals in the traffic jams as well as the expended fuel and any resulting pollution due to the significant number of vehicles being at a stand still. Basing a fine upon the resulting impact is an attempt to recover some of those costs.

As an alternative form of traffic disturbance, motorists may fail to give the right away to emergency vehicles and thereby impact the ability of emergency vehicles to reach their intended destinations. In such emergency vehicle situations, it is likely that this impact has more severe consequences than for traffic jam disturbances as shown in FIG. 1. With emergency vehicles being impacted, lives are put at greater risk whereas with traffic jams, it is often a matter of convenience.

In either of the exemplary traffic disturbance situations noted above, in order to capture information about the traffic disturbance scenario, a collection of sensors may be present to collect data regarding both the cause of the traffic disturbance, i.e., accident 102, as well as the resulting impact, i.e., the six traffic jams. The sensors may be, for example, still frame cameras, video cameras, roadway sensors for collecting speed and volume of vehicles, as well as in-car sensors. In-car sensors may include, for example, still frame cameras, video cameras, cell phone cameras, and vehicle parameter sensors such as speed sensors, brake sensors, steering input sensors, accelerator sensor, direction of travel sensor, etc. Thus, data may be collected regarding vehicle direction, vehicle speed, vehicle acceleration, steering input, accelerator input, and brake input as well as other factors for which other sensors are present. The in-car sensors may be included in the vehicle(s) causing the traffic disturbance as well as those vehicles that are being impacted by the traffic disturbance. Thus, data may be collected from conventionally available sensors and/or new sensors that are provided for this specific purpose.

Figure 2:
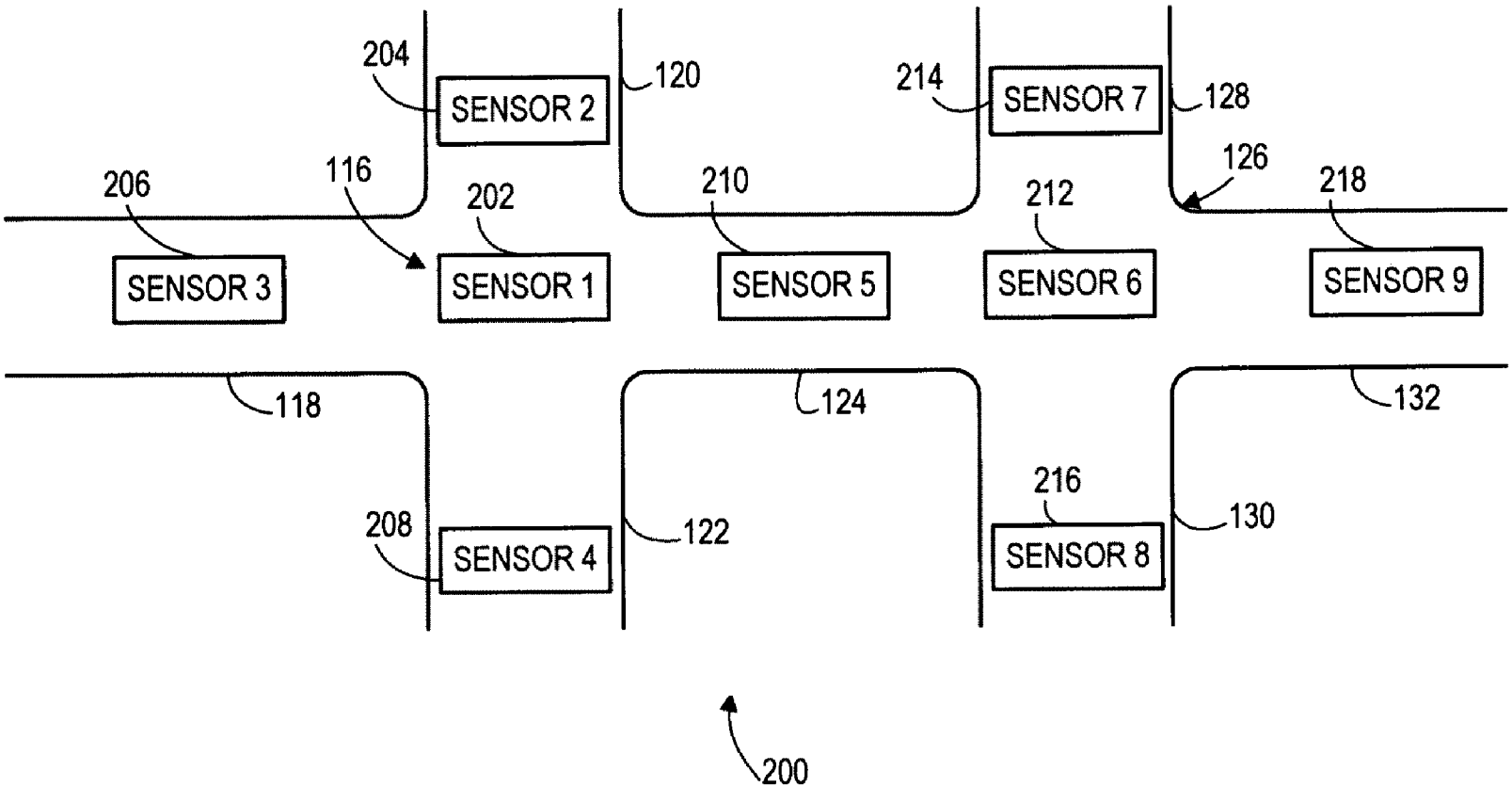
FIG. 2 shows an example of a collection of sensors in place to capture data reflecting the cause and the impact of the traffic disturbance.

As shown in FIG. 2, there may be a first sensor 202 at the intersection 116 which may capture data regarding the cause of the accident or other event resulting in the traffic disturbance. For example, sensor 202 may include a stop light sensor that photographed a vehicle as it passed through the intersection during a red light. The sensor 202 may be an in-car sensor in the vehicle involved in the accident or other event that shows that the vehicle had a given speed and that no brakes were applied in the instant prior to a collision occurring. Other sensors immediately adjacent to the intersection, such as the second sensor 204, the third sensor 206, the fourth sensor 208 and the fifth sensor 210 may also gather data representative of the cause of the accident or other event. For example, one or more of these sensors may be an in-car camera of a vehicle immediately behind one of the vehicles involved in the collision or other event in the intersection 116 which has captured video footage of the collision or other event. One or more of these sensors may be overhead cameras that have captured video footage of the intersection 116 during the collision or other event and/or that capture footage of the vehicles that are collecting within the traffic jams.

Additional sensors that are too far from the intersection 116 to capture data representative of the cause may also capture data that is representative of the impact of the collision or other event. For example, the sixth sensor 212, seventh sensor 214, and eighth sensor 216 may collect data such as video or still photos of the traffic jams that have developed at the nearby intersection 126.

Figure 3:
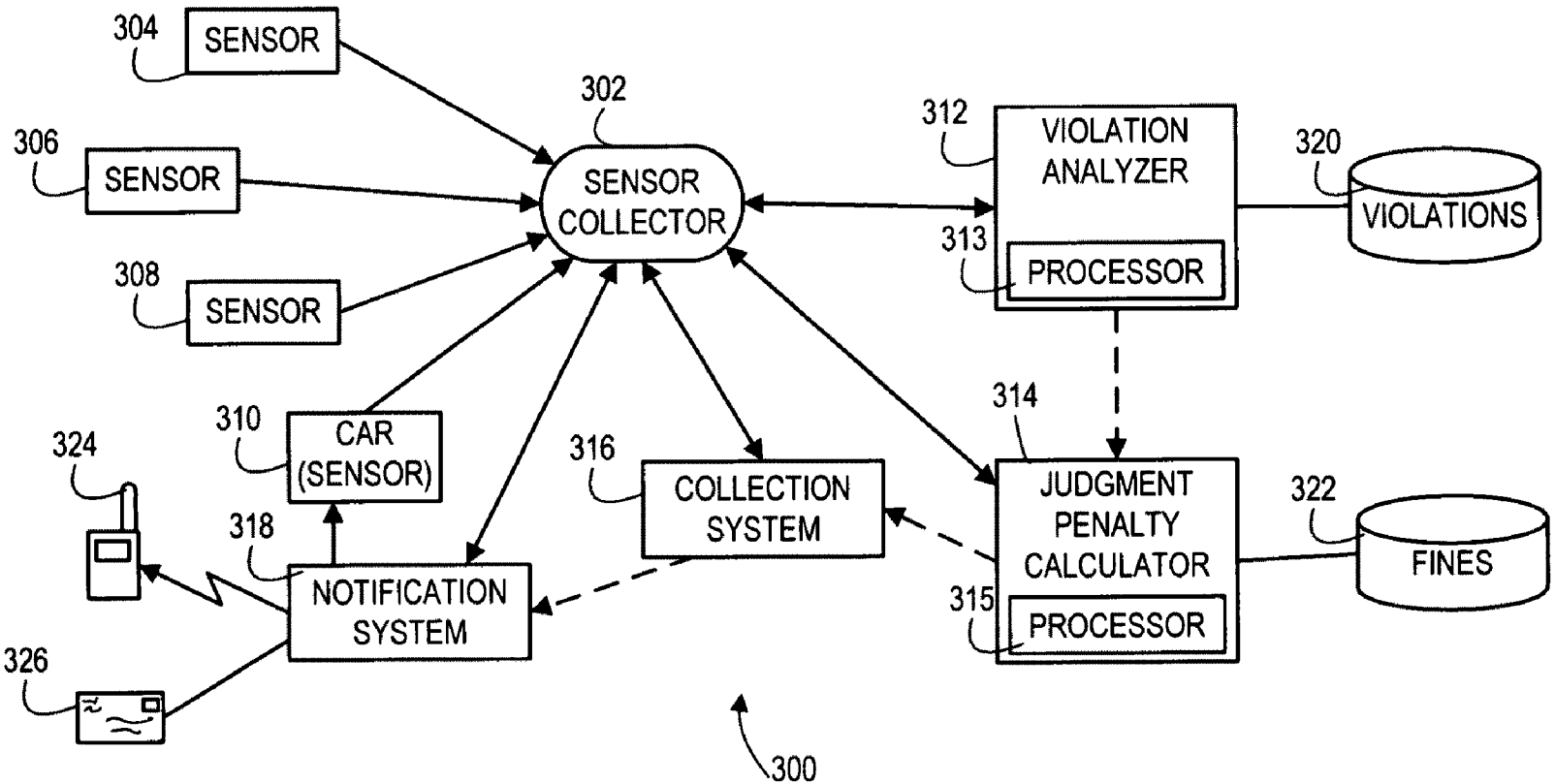
FIG. 3 shows an example of a system that collects the data from the sensors and processes the data to determine whether a traffic violation has occurred, what the resulting fine should be based on the impact, and then attempts to collect on the fine by notifying the responsible entity.

FIG. 3 shows an example of a system 300 that may acquire the sensor data and assess an appropriate fine for the traffic disturbance. This example includes a sensor collector system 302 which communicates with each of the sensors 304, 306, 308, and 310 that have been collecting data about the traffic disturbance, including data representative of the cause and data representative of the impact at sensor operation 402 of FIG. 4. The sensor collector system 302 may communicate with the various sensors through both wired and wireless connectivity. For example, the sensor collector system 302 may communicate with roadway sensors including speed sensors, volume sensors, and overhead cameras through wired infrastructure or through wireless connectivity. The sensor collector system 302 may communicate with in-car sensors via wireless communications.

The sensor collector system 302 may detect the occurrence of a traffic disturbance such as by performing, for example, image processing or other signal processing to detect that traffic has stopped flowing at a normal rate. For example, the sensor collector system 302 may receive data from roadway sensors to indicate the current traffic flow and may compare that to historical values to determine an abnormality. As an alternative, the sensor collector system 302 may be listening for ad hoc communication from in-car sensors that are preconfigured to broadcast an alert upon detecting a particular condition, such as a collision. Upon becoming aware of the traffic disturbance, the sensor collector system 302 may then broadcast requests for data within the proximity of the initial disturbance so that sensors that do not ordinarily collect and submit data, such as in-car sensors for vehicles of the traffic jams, begin doing so.

Once the sensor collector system 302 has collected data regarding the cause and impact of the traffic disturbance, this information may then be provided to other devices of the system 300. Each of the devices of the system 300 may be implemented as independent devices or may operate as independent logical modules of a single device. In either case, the logical functions performed by each of the independent devices or logical modules may be stored as instructions on a computer readable medium. A computer readable medium may be of various forms such as magnetic, electronic or optical storage or transport media such as wired or wireless connections.

In order for the system 300 to proceed with determining what the fine should be for a responsible party, there is first a determination of liability by analyzing whether a traffic violation has occurred. At data operation 404 of FIG. 4, the sensor collector system 302 passes data that is representative of the cause of the traffic disturbance to a violation analyzer device 312 where it is determined whether a violation has occurred at query operation 406.

Violation analyzer 312 receives the data representative of the cause and performs image and digital signal processing upon it to extract vehicle parameter information, such as the speed, application of brakes, steering input, and any other data reflective of operation and activity of the vehicle. As discussed above, this data may come from in-car sensors, roadway sensors, etc. The violations analyzer 312 accesses a traffic violations rule set 320 that sets forth the elements to be satisfied for a variety of traffic violations. A processor 313, such as a general purpose programmable processor or a dedicated purpose processor containing hardwired digital logic, of the violation analyzer 312 performs a comparison of the requirements of each element of each traffic violation to the collected data representative of the cause to determine whether the vehicle parameters of each traffic violation are satisfied by the vehicle parameters of the collected data. The operation of the violation analyzer discussed below relative to FIG. 5.

When a traffic violation is discovered, then the particular violation that has occurred is provided to a penalty calculator device 314. The violation may be transferred directly from the violation analyzer 312, as indicated by the dashed lines, or may be provided from the violation analyzer 312 to the sensor collector 302 and from the sensor collector 302 back to the penalty calculator 314.

Figure 4:
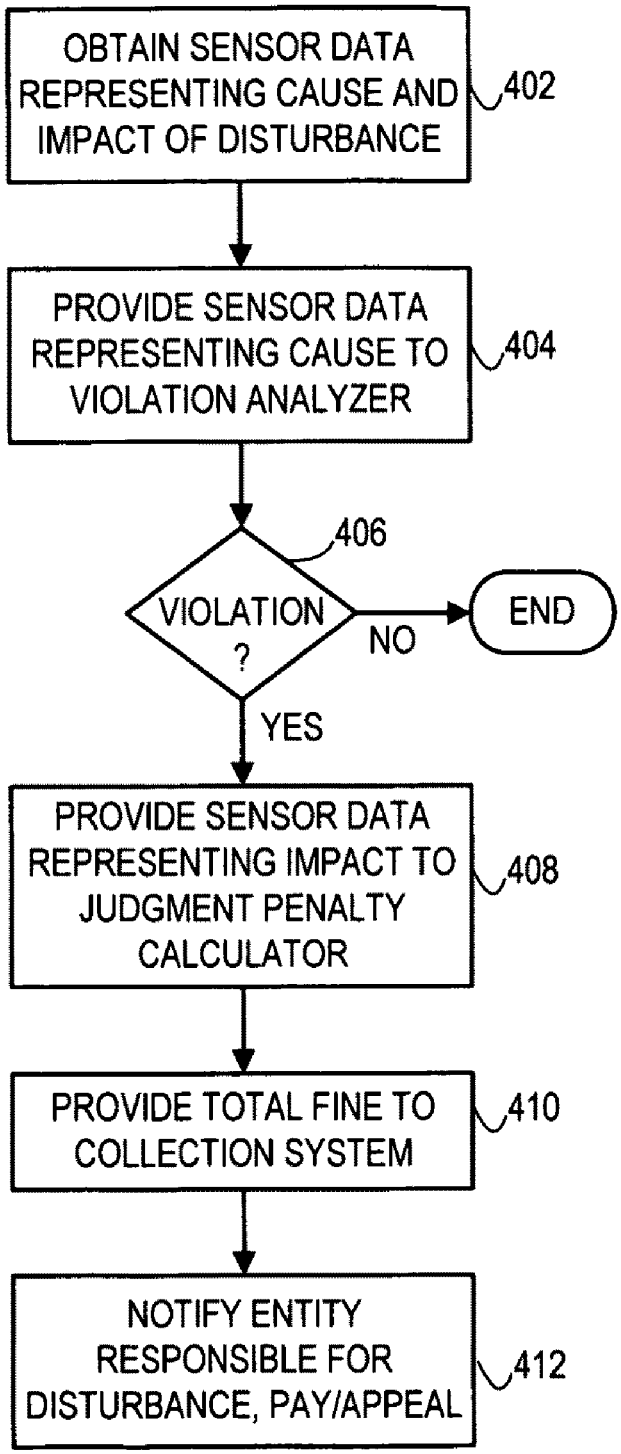
FIG. 4 shows an example of an operational flow of the system of FIG. 3.

The penalty calculator 314 receives the data indicating the particular traffic violation that has occurred, such as a traffic violation code number, and also receives data representative of the impact of the traffic disturbance from the sensor collector 302 at data operation 408 of FIG. 4. The data representative of the impact may include the number of vehicles that have been present in the traffic jams that have developed. For example, the overhead cameras may collect images from which the number of vehicles may be counted. Additionally, the in-car sensors of each of the vehicles of the traffic jam may be queried by the broadcasted request and may then submit a reply to indicate that they are present within the traffic jam. The penalty calculator 314 may perform image and digital sensor processing to determine the total count of vehicles involved and to determine the severity of the impact including the amount of time the vehicles were in the traffic jam.

The penalty calculator 314 may then assess the fine once the impact has been determined in terms of the number of vehicles affected and the severity of the impact in terms of the time of the traffic jams and any related factors. The penalty calculator 314 may have access to a rule set 322 for assessing fines where the rule set 322 associates particular traffic violations with particular fines per vehicle affected. Furthermore, the rule set may also vary the fine per vehicle based on the total number of vehicles affected, where the fine per vehicle for low volume is higher than that for high volume so that low volume disturbances may have a meaningful fine assessed. A processor 315 of the penalty calculator 314 performs the look-up of the violation, number affected, and severity to find the appropriate fine per vehicle and then computes the total fine based on the total number of vehicles impacted.

According to an exemplary embodiment, the total fine and the data representing the cause are then provided to a collection system 316 at collection operation 410. The collection system 316 handles collecting the fine from the responsible entity. Either the collection system 316 itself may perform image or digital signal processing to identify the vehicle responsible for the accident or this information may be determined by the violation analyzer 312 which then passes then information directly or though the sensor collector 302 to the collection system 316. For example, the license plate may be photographed by any of the sensors 304, 306, and 308, the vehicle identification number (VIN) may be reported by the in-car sensor 310, etc. The collection system 316 may then look up the entity responsible for the vehicle in the motor vehicle registration database, including the addresses for contacting the entity in order to present the violation. Upon determining the responsible entity, the collection system 316 may then trigger a notification system 318 to provide the notice of the violation to the responsible entity at notification operation 412.

The notification system 318 may provide the notification in a variety of ways. For example, the entity responsible may have a personal communication device, such as a mobile telephone 324 or a communication device built-in to the vehicle 310 and a wireless signal provides an electronic message. This electronic message may explain the violation and offer a pay or appeal option for the entity to select. When the pay option is elected, notice of this option may be provided back to the collection system 316 so that a payment method on file for the entity is utilized to cover the payment, such as charging a credit card. When the appeal option is elected, the collection system 316 may then submit an electronic message to the appropriate judicial office where the appeal will be handled. As another example, the notification system 318 may generate a paper ticket 326 that is mailed or otherwise delivered to the entity identified as being responsible for the traffic disturbance.

As an additional feature that may be provided, the collection system 316 may also detect the identity of entities that own or are otherwise responsible for the vehicles being affected by the traffic jams. This may be done in the manner discussed above for detecting the vehicle(s) and corresponding entities that are responsible for the traffic jam. Namely, photographs of the license plates may be captured, image processing may be performed, and/or the in-car sensors may report the VIN of each of the vehicles in the traffic jam. Upon identifying these affected entities, a portion of the total fine collected may then be designated for allocation among those affected. The collection system 316 may then provide the allocated portion to each entity such as by crediting an account on file, such as a credit card account.

Figure 5:
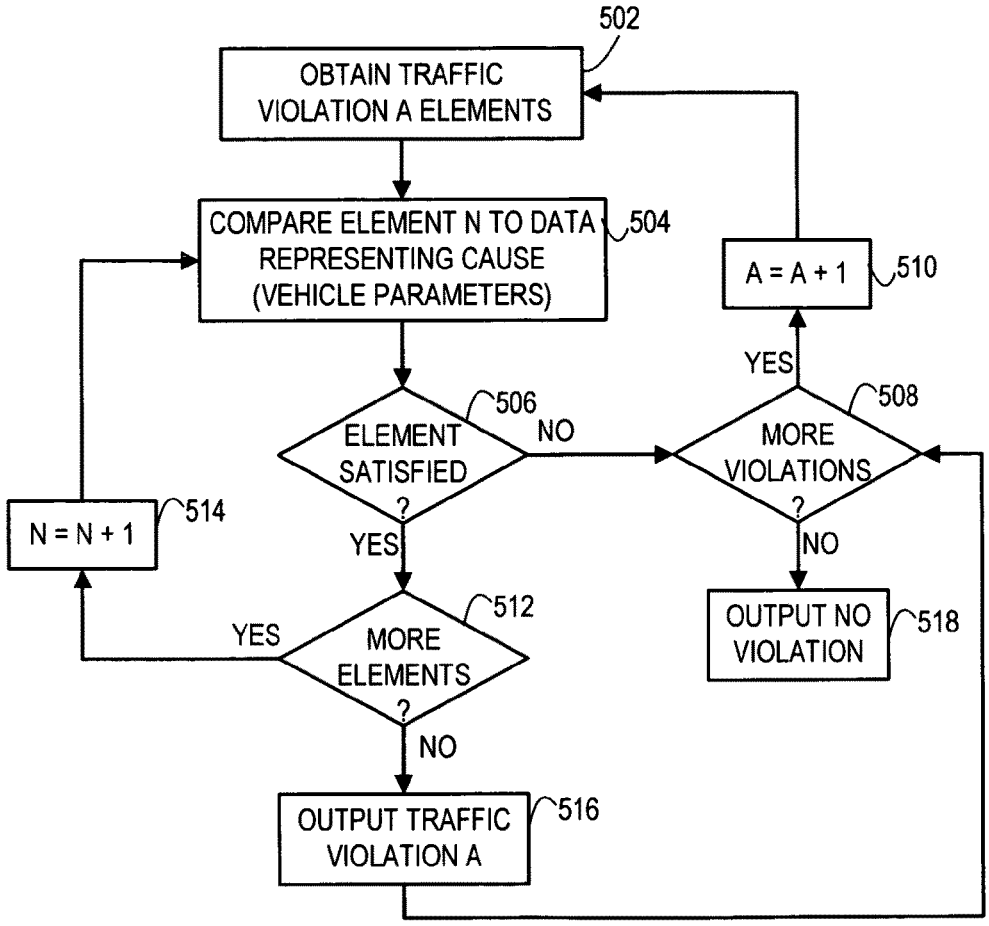
FIG. 5 shows an example of an operational flow of a violation analyzer of the system of FIG. 3.

FIG. 5 shows an example of the operational flow for the violation analyzer 312 to determine whether a traffic violation has occurred. Initially, the violation analyzer 312 obtains the elements for a first traffic violation to be considered at violation operation 502. Each traffic violation may be specified in terms of the vehicle parameters that must be satisfied. For example, one violation to be considered is whether a red stop light has been violated. In this example, the elements may be set forth as: was the car still in the intersection when the traffic light turned red; if so, was the car in excess of a certain distance when the light turned yellow; and if so, was the speed of the car in excess of a certain amount while under the speed limit when the traffic light turned yellow.

The violation analyzer compares the first element to the data representing the cause of the disturbance, including comparing specified vehicle parameters of the element to the detected vehicle parameters at comparison operation 504. Assuming the first violation to be considered is speeding, the first element may be was the highest speed of the vehicle that was detected prior to the disturbance occurring in excess of a specified maximum. Assuming in this example that the vehicle was not speeding, then query operation 506 detects that the vehicle does not satisfy the first element. Query operation 508 then detects whether there are more violations to consider. If not, then the violation analyzer outputs an indication of no violation at output operation 518 since all of the elements of any one violation have not been satisfied. If query operation 508 detects that there are more violations, then the violation counted is incremented at counter operation 510 to proceed on to the next violation.

Where query operation 506 detects that a first element of the current violation being considered is satisfied, then operational flow proceeds to query operation 512 where it is detected whether the current violation being considered has additional elements to be satisfied. If so, then counter operation 514 increments the element counter so that the next element is then considered. If not, then the violation analyzer 312 outputs the code for the current traffic violation being considered. Where multiple violations may be utilized in assessing the penalty, operational flow may then proceed to query operation 508 where it is determined whether any additional violations remain to be considered. For example, if the vehicle was speeding when it ran a stop light and caused an accident, then the fine may be increased due to a speeding violation in conjunction with a stop light violation.

Figure 6:
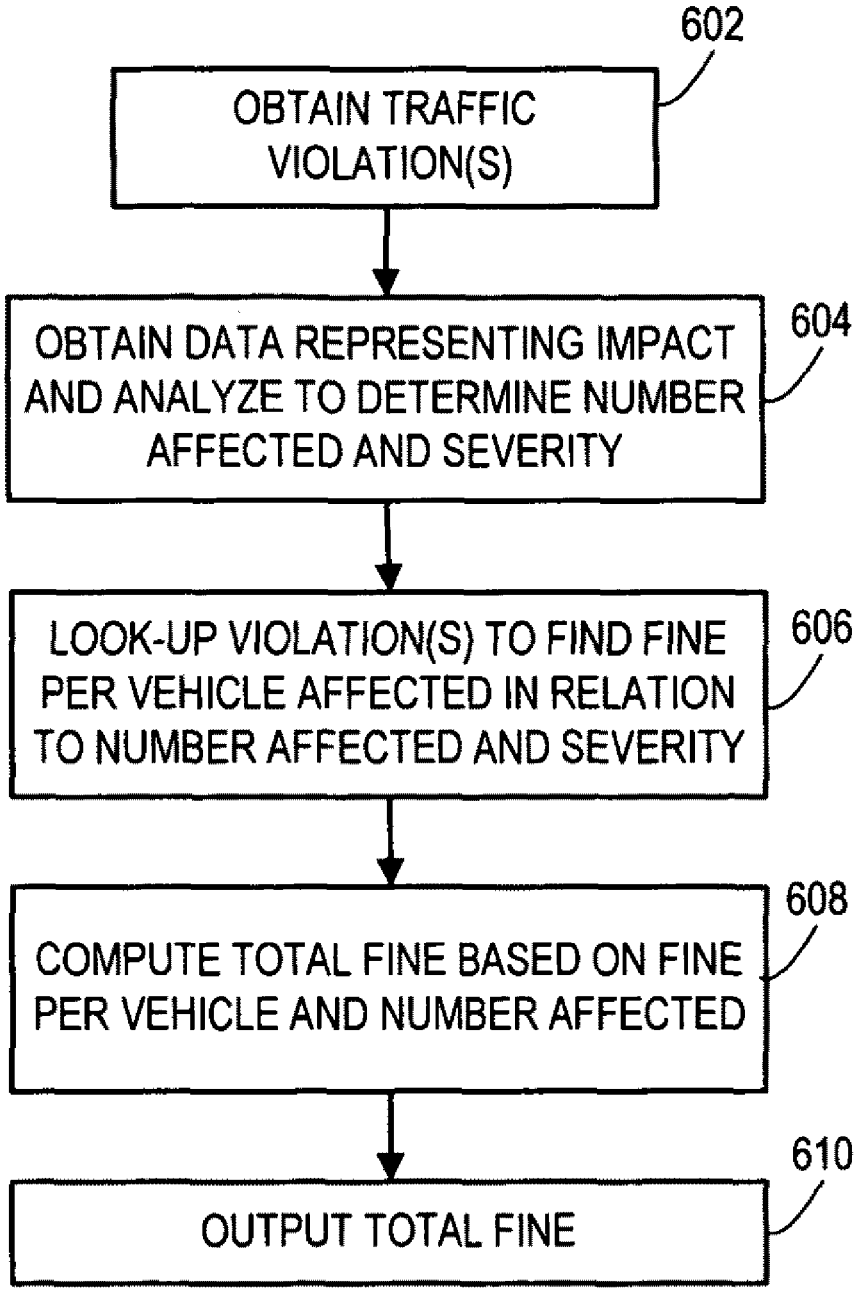
FIG. 6 shows an example of an operational flow of a penalty calculator of the system of FIG. 3.

FIG. 6 shows an example of the operational flow of the penalty calculator 314. Initially, the one or more traffic violations that have been found by the violation analyzer 312 are obtained at violation operation 602. The penalty calculator 314 then obtains the data representing the impact and analyzes that data to determine the number of vehicles affected and the severity of the effect at analysis operation 604.

To determine the impact, the penalty calculator 314 may apply image and digital signal processing to the obtained data to recognize each of the vehicles and increase the count of the total number of vehicles affected. Furthermore, when determining the impact the penalty calculator 314 may also determine the severity of the impact by measuring an amount of time that the traffic jams are sustained. The determined impact may then be used to compute the total fine based on the number of vehicles affected at computation operation 608.

The total fine may be computed by multiplying a fine per vehicle, or microfine, by the total number of vehicles affected. This microfine is typically an amount much smaller than a typical fine, such as less than one dollar per vehicle affected for sizable traffic jams. However, the computation of the total fine may take into account different factors by having the fine per vehicle vary. For example, to compute the total fine, a fine per vehicle affected may be determined at look-up operation 606 by finding the violation(s) that have occurred and finding the fine per vehicle for the particular violation(s). If the violation is minor, such as speeding by less than five miles per hour, then the microfine may be less than if the violation is major, such as speeding by more than 10 miles per hour. Furthermore, where multiple violations have occurred, the microfine may be more than if only a single violation had occurred. Additionally, the fine per vehicle may additionally be based on the total number of vehicles that have been impacted such as having a fine of X dollars for each vehicle under 100 impacted while having a fine of Y dollars for each vehicle impacted in excess of 100.

Once the microfine has been found from the look-up of the violation, then the total fine is found at computation operation 608. The total fine is then output to other systems and devices, such as the collection system 316 at output operation 610.

The fine that is being assessed may be one of or a combination of various things. For example, the fine may be a dollar amount that the responsible entity must pay. As another example, the fine may be points against the responsible entity where exceeding a points limit results in the loss of the right to operate a vehicle. Furthermore, the fine may be a dollar amount that must be paid and a number of points that are accrued. With the possibility of large dollar and/or point fines occurring for causing traffic disturbances, operators of vehicles as well as other individuals who may affect traffic including pedestrians are deterred from behaving carelessly.

While the invention has been particularly shown and described with reference to various embodiments thereof, it will be understood by those skilled in the art that various other changes in the form and details may be made therein without departing from the spirit and scope of the invention.

What is claimed is:

1. A method for assessing fines for traffic disturbances comprising:

(a) collecting data regarding a cause of a traffic disturbance and data reflecting an impact of the traffic disturbance;

(b) using a processor, comparing the collected data regarding the cause to a traffic violation rule set to detect whether the data regarding the cause represents a traffic violation; and (c) computing a total fine based on the data reflecting the impact of the traffic disturbance.

2. The method of claim 1, wherein the impact of the traffic disturbance reflects a number of vehicles impacted.

3. The method of claim 1, further comprising computing the total fine based on the particular traffic violation.

4. The method of claim 1, further comprising identifying an entity responsible for the traffic disturbance from the data regarding the cause.

5. The method of claim 4, further comprising presenting the total fine to the entity identified as being responsible for the traffic disturbance.

6. The method of claim 5, further comprising presenting an option to the entity identified as being responsible to pay the total file or appeal the fine.

7. The method of claim 5, further comprising at least one of transferring an electronic message to an electronic device of the entity responsible for the traffic disturbance and generating a paper ticket addressed to the entity responsible for the traffic disturbance.

8. The method of claim 1, further comprising identifying those affected by the traffic disturbance and determining a portion of the total fine to grant to those affected.

9. The method of claim 1, further comprising capturing an image of a vehicle of the entity responsible for the traffic disturbance and capturing an image of a group of vehicles impacted.

10. The method of claim 9, further comprising performing pattern recognition on a number of vehicles present in the image of the group of vehicles impacted.

11. The method of claim 9, further comprising determining an amount of the fine to remit to each of the vehicles that are impacted.

* * * * *